US008920111B2

(12) United States Patent
Lee et al.

(10) Patent No.: US 8,920,111 B2
(45) Date of Patent: Dec. 30, 2014

(54) AIRFOIL INCORPORATING TAPERED COOLING STRUCTURES DEFINING COOLING PASSAGEWAYS

(75) Inventors: Ching-Pang Lee, Cincinnati, OH (US); John J. Marra, Winter Springs, FL (US)

(73) Assignees: Siemens Energy, Inc., Orlando, FL (US); Mikro Sysytems, Inc., Charlottesville, VA (US)

( * ) Notice: Subject to any disclaimer, the term of this patent is extended or adjusted under 35 U.S.C. 154(b) by 1103 days.

(21) Appl. No.: 12/908,029

(22) Filed: Oct. 20, 2010

(65) Prior Publication Data

US 2011/0171023 A1 Jul. 14, 2011

Related U.S. Application Data

(60) Provisional application No. 61/253,120, filed on Oct. 20, 2009.

(51) Int. Cl.
*F01D 5/18* (2006.01)
*B22C 9/10* (2006.01)

(52) U.S. Cl.
CPC ..... *F01D 5/187* (2013.01); *B22C 9/103* (2013.01); *F05D 2240/122* (2013.01); *F05D 2240/304* (2013.01); *F05D 2250/18* (2013.01); *F05D 2230/21* (2013.01); *F05D 2250/292* (2013.01)
USPC ..... 415/115; 416/97 R

(58) Field of Classification Search
CPC ... F01D 5/186; F01D 5/187; F05D 2240/112; F05D 2240/304; F05D 2250/18; F05D 2250/292; F05D 2260/202; F05D 2260/203
USPC ..... 415/1, 115, 116; 416/97 R
See application file for complete search history.

(56) References Cited

U.S. PATENT DOCUMENTS

| | | | | |
|---|---|---|---|---|
| 3,819,295 | A * | 6/1974 | Hauser et al. | 416/97 R |
| 3,934,322 | A | 1/1976 | Hauser et al. | |
| 5,370,499 | A | 12/1994 | Lee | |
| 5,503,529 | A | 4/1996 | Anselmi | |
| 5,511,946 | A | 4/1996 | Lee | |
| 5,690,472 | A * | 11/1997 | Lee | 416/97 R |
| 5,752,801 | A * | 5/1998 | Kennedy | 415/115 |

(Continued)

FOREIGN PATENT DOCUMENTS

| | | |
|---|---|---|
| EP | 1749972 A2 | 2/2007 |
| EP | 1925780 A1 | 5/2008 |

(Continued)

OTHER PUBLICATIONS

U.S. Appl. No. 12/832,124.

*Primary Examiner* — Edward Look
*Assistant Examiner* — Jesse Prager

(57) ABSTRACT

A gas turbine engine (10) and an airfoil (50) for use therein, the airfoil (50) having a structure (128) containing cooling passageways (110, 120) extending between a chamber (100) and a series of apertures (78) positioned along the trailing edge (72) through which cooling fluid (144) received from the chamber (100) exits the airfoil (50), wherein the structure (128) is characterized by a variable thickness (t) between the pressure and suction sidewalls (74, 76) of the airfoil as a function of position along the cooling passageways (110, 120) such that each in a plurality of cooling passageways are characterized by a cross sectional flow area (170, 174) which decreases as a function of distance from the chamber (100).

18 Claims, 8 Drawing Sheets

(56) References Cited

U.S. PATENT DOCUMENTS

| | | | | |
|---|---|---|---|---|
| 6,179,565 | B1 | 1/2001 | Palumbo | |
| 6,325,593 | B1 | 12/2001 | Darkins | |
| 6,379,118 | B2 | 4/2002 | Lutum | |
| 6,402,470 | B1 | 6/2002 | Kvasnak | |
| 6,652,235 | B1 | 11/2003 | Keith | |
| 6,981,840 | B2 | 1/2006 | Lee | |
| 7,114,923 | B2 | 10/2006 | Liang | |
| 7,186,084 | B2 | 3/2007 | Bunker | |
| 7,281,895 | B2 | 10/2007 | Liang | |
| 7,674,092 | B2 * | 3/2010 | Annerfeldt et al. | 416/97 R |
| 2007/0172354 | A1 * | 7/2007 | Annerfeldt et al. | 416/97 R |
| 2012/0070306 | A1 * | 3/2012 | Lee et al. | 416/97 R |

FOREIGN PATENT DOCUMENTS

| | | | |
|---|---|---|---|
| GB | 2401915 | A | 11/2004 |
| JP | 62228063 | A | 10/1987 |
| JP | 2000-053543 | A | 11/1999 |
| WO | 2008081486 | A1 | 7/2008 |

* cited by examiner

AIRFOIL INCORPORATING TAPERED COOLING STRUCTURES DEFINING COOLING PASSAGEWAYS

RELATED APPLICATION

This application claims priority to the Provisional U.S. Patent Application Ser. No. 61/253,120 filed 20 Oct. 2009, which is incorporated herein by reference in the entirety. This application relates to co-pending application Ser. No. 12/832,124 filed on 8 Jul. 2010.

FIELD OF THE INVENTION

The invention relates to turbine airfoils having structures which provide cooling channels within gas turbine blades and vanes.

BACKGROUND OF THE INVENTION

A typical gas turbine engine includes a fan, compressor, combustor, and turbine disposed along a common longitudinal axis. Fuel and compressed air discharged from the compressor are mixed and burned in the combustor. The resulting hot combustion gases (e.g., comprising products of combustion and unburned air) are directed through a conduit section to a turbine section where the gases expand to turn a turbine rotor. In electric power applications, the turbine rotor is coupled to a generator. Power to drive the compressor may be extracted from the turbine rotor.

With the efficiency of a gas turbine engine increasing with operating temperature, it is desirable to increase the temperature of the combustion gases. However, temperature limitations of the materials with which the engine and turbine components are formed limit the operating temperatures. Airfoils are exemplary. The term airfoil as used herein refers to a turbine airfoil which may be a rotor (rotatable) blade or a stator (stationary) vane. Due to the high temperature of the combustion gases, airfoils must be cooled during operation in order to preserve the integrity of the components. Commonly, these and other components are cooled by air which is diverted from the compressor and channeled through or along the components. It is also common for components (e.g., nozzles) to be cooled with air bled off of the fan rather than the compressor.

Effective cooling of turbine airfoils requires delivering the relatively cool air to critical regions such as along the trailing edge of a turbine blade or a stationary vane. The associated cooling apertures may, for example, extend between an upstream, relatively high pressure cavity within the airfoil and one of the exterior surfaces of the turbine blade. It is a desire in the art to provide increasingly effective cooling designs and methods which result in more effective cooling with less air. It is also desirable to provide more cooling in order to operate machinery at higher levels of power output. Generally, cooling schemes should provide greater cooling effectiveness to create more uniform material temperature or greater heat transfer from the material.

Ineffective cooling can result from poor heat transfer characteristics between the cooling fluid and the material to be cooled with the fluid. In the case of airfoils, it is known to establish film cooling along a wall surface. A cooling air film traveling along the surface of a wall can be an effective means for increasing the uniformity of cooling and for insulating the wall from the heat of hot core gases flowing thereby. However, film cooling is difficult to maintain in the turbulent environment of a gas turbine.

Consequently, airfoils commonly include internal cooling channels which remove heat from the pressure sidewall and the suction sidewall in order to minimize thermal stresses. A high cooling efficiency, based on the rate of heat transfer, is an important design consideration in order to minimize the volume of air diverted from the compressor for cooling. By way of comparison, the aforementioned film cooling, providing a film of cooling air along outer surfaces of the airfoil, via holes from internal cooling channels, is somewhat inefficient due to the number of holes are needed and the resulting high volume of cooling air diverted from the compressor. Thus, film cooling has been used selectively and in combination with other cooling techniques. It is also known to provide serpentine cooling channels within a component.

However, the relatively narrow trailing edge portion of a gas turbine airfoil may include up to about one third of the total airfoil external surface area. The trailing edge is made relatively thin for aerodynamic efficiency. Consequently, with the trailing edge receiving heat input on two opposing wall surfaces which are relatively close to each other, a relatively high coolant flow rate is desired to provide the requisite rate of heat transfer for maintaining mechanical integrity. In the past, trailing edge cooling channels have been configured in a variety of ways to increase the efficiency of heat transfer. For example U.S. Pat. No. 5,370,499, incorporated herein by reference, discloses use of a mesh structure comprising cooling channels which exit from the trailing edge.

The present invention increases heat transfer efficiency and uniformity of cooling via channels placed in the trailing edge of a turbine airfoil.

BRIEF DESCRIPTION OF THE DRAWINGS

The invention is explained in the following description in view of the drawings wherein.

Like reference numbers are used to denote like features throughout the figures.

DETAILED DESCRIPTION OF THE INVENTION

Figure 1:
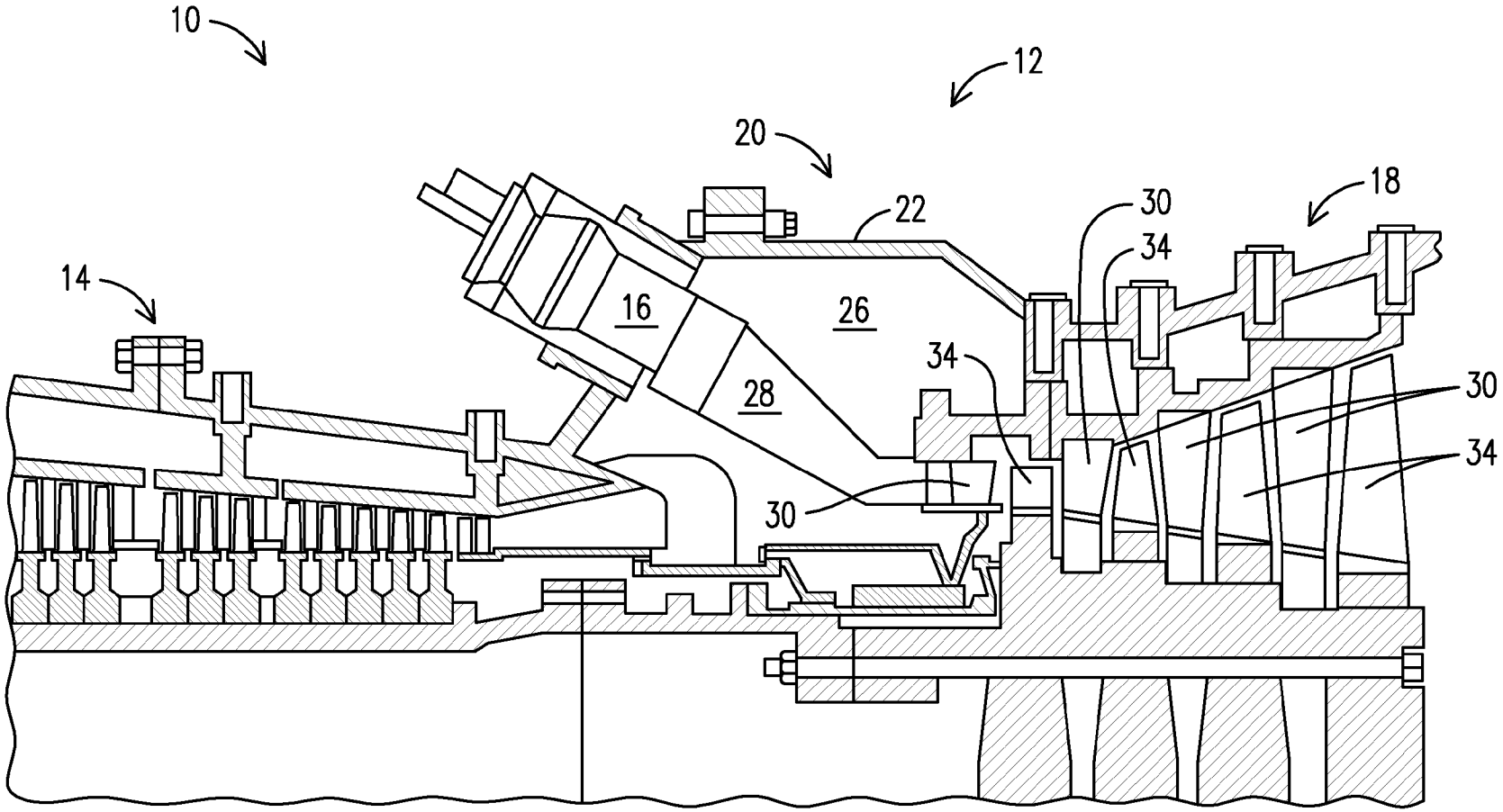
FIG. 1 is a simplified schematic diagram illustrating a cross sectional view of a portion of a gas turbine power generation system incorporating embodiments of the invention.

FIG. 1 is a schematic illustration of a portion of a gas turbine power generation system 10 taken in cross section and incorporating embodiments of the invention. The system 10 incorporates one or more spaced-apart arrays of cooling passageways according to the invention. A gas turbine engine 12 of the system 10 includes a compressor 14 which feeds air to a combustion chamber 16 and a turbine 18 which receives hot exhaust gas from the combustion chamber. A mid-frame section 20, disposed between the compressor 14 and the turbine 18, is defined in part by a casing 22 formed about a plenum 26 in which the combustion chamber 16 (e.g., shown as a can-annular combustor) and a transition duct 28 are situated. During operation the compressor 14 provides compressed air to the plenum 26 through which the compressed air passes to the combustion chamber 16, where the air is mixed with fuel (not shown). Combusted gases exiting the combustion chamber 16 travel through the transition duct 28 to the turbine 18, providing rotation which turns an electric generator (not shown). The plenum 26 is an annular chamber that holds a plurality of circumferentially spaced apart combustion chambers 16 each associated with a downstream exhaust transition duct 28 through which hot exhaust gases pass toward the turbine 18. The turbine 18 comprises a series of stationary vanes 30 and rotatable blades 34 along which the hot exhaust gases flow.

The combustion chamber 26, and other components (e.g., vanes and blades) along which the hot exhaust gases flow, are cooled to counter the high temperature effects which the hot exhaust gases would otherwise have on component materials. Commonly, at least the initial blade stages within the turbine 18 are cooled using air bled from various stages of the compressor 14 at a suitable pressure and temperature to effect flow of cooling fluid along exterior surfaces of materials which are in the path of the hot exhaust gases. For example, a plurality of cooling openings may be formed through pressure and suction sidewalls of the blade. Conventionally, cooling fluid which flows through the base of the blade to the airfoil portion may follow a serpentine path within the airfoil to reach the openings.

For described embodiments of the invention, the cooling fluid also flows through mesh cooling passages. Prior designs of mesh cooling passages are described in U.S. Pat. No. 5,370,499. A feature of the invention is provision of a variety of arrays of cooling passageways disposed within airfoils along the path of the hot exhaust gases in the turbine 18. Thermal energy is transferred from the pressure and suction sidewalls of the airfoils to cooling fluid which passes through the cooling passageways in the arrays. One or more arrays of the modules can be disposed in any airfoil that requires cooling, e.g., airfoils having walls for which temperature must be limited to preserve the integrity of the associated component.

Figure 2:
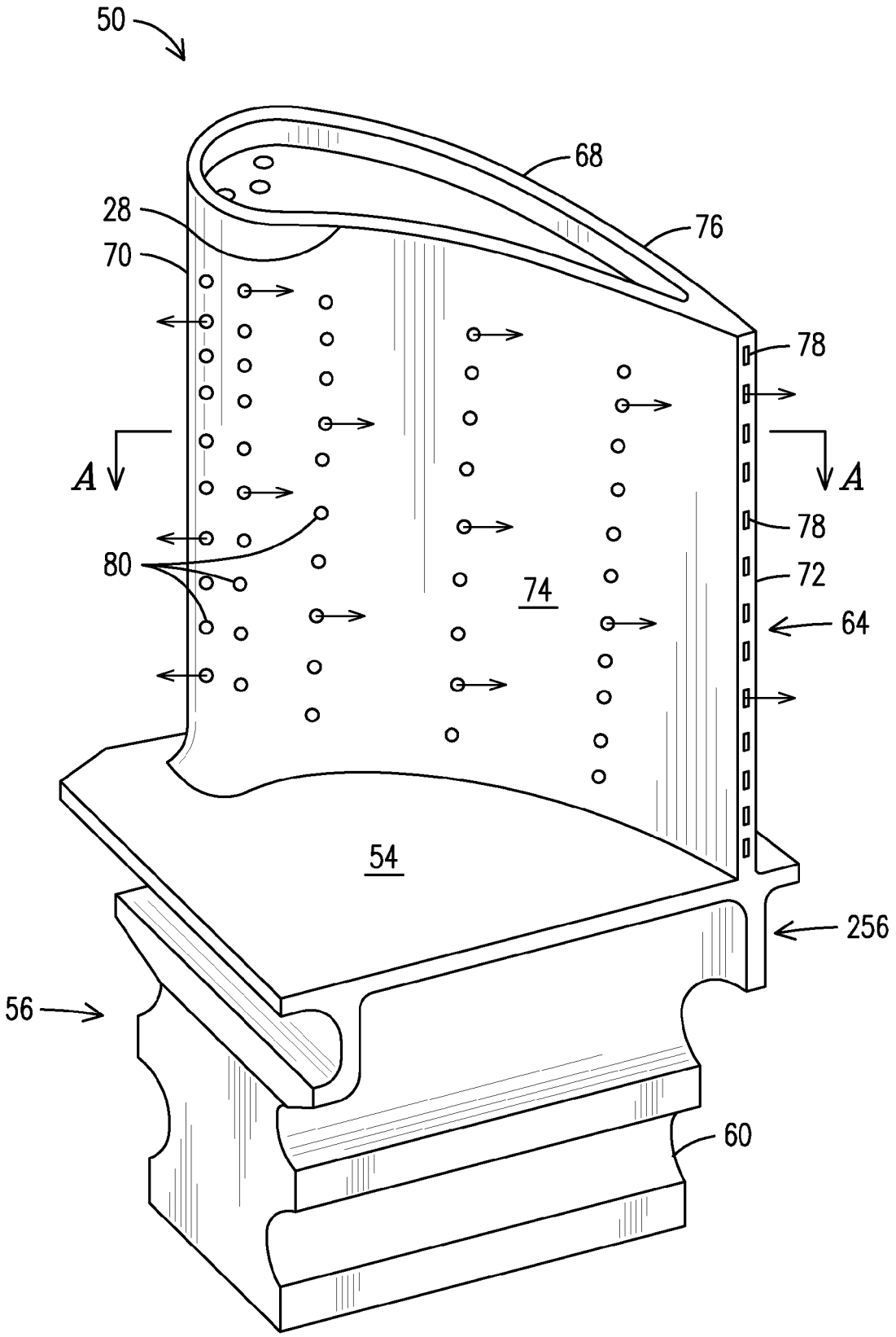
FIG. 2 is an elevation view of a turbine blade in which one or more arrays of cooling passageways are formed.

With reference to the several embodiments of the invention described herein, the rotatable turbine blade 50 shown in the perspective view of FIG. 2 is exemplary of an airfoil incorporating one or more arrays of cooling passageways along the path of the hot exhaust gases in the turbine 18. The blade 50 includes a platform 54 formed on a base 56 beneath which is a conventional dove-tail root 60. The airfoil portion 64 extends upward from the platform 54 to an upper end 68 near or at the top of the blade. The airfoil extends horizontally (along the plane of the platform 54) from a relatively wide leading edge region 70 to a narrow trailing edge 72. The airfoil includes a pressure side wall 74 and a suction side wall 76 opposing the pressure side wall, each extending between the leading edge region 70 and the relatively narrow trailing edge 72. A series of apertures 78 are formed along the trailing edge 72 through which cooling fluid, also bled from various stages of the compressor 14, and then passed through the turbine blade 50, exits passageways interior to the blade. Although the apertures 78 are illustrated as being slotted in shape, the openings may be any of numerous aperture shapes. As noted above, a plurality of cooling openings 80 are formed through the pressure and suction side walls 74 and 76. The openings 80 are in fluid communication with one or more chambers within the blade 50 (not shown) to pass cooling fluid along exterior surfaces, i.e., portions of the walls 74, 76 in the path of the hot exhaust gases.

As is well known, turbine blades are castings, commonly formed with intricate interior features to facilitate flow of cooling fluid. Arrays of cooling passageways according to numerous embodiments of the invention may be formed between the pressure and suction side walls 74, 76 of the turbine blade 50 in such a casting process from, for example, a ceramic core, although other suitable materials may be used. An exemplary process for fabrication is available from Mikro Inc., of Charlottesville Va. See, for example, U.S. Pat. No. 7,141,812 which is incorporated herein by reference. Also, for the embodiments illustrated in the figures, the arrays of cooling passageways may be integrally formed with one another in the casting process. Multiple arrays of cooling passageways can be formed in the casting process to create a series of cooling arrays extending along the interior of the blade 50. For purposes of describing features of the illustrated embodiments, the passageways in each array are rectangular-shaped volumes formed with pairs of parallel opposing walls, but the various passageways may be formed with many other geometries and the cross sectional shapes and sizes of the various passageways may vary, for example, to meter the flow of cooling gases.

Figure 3A:
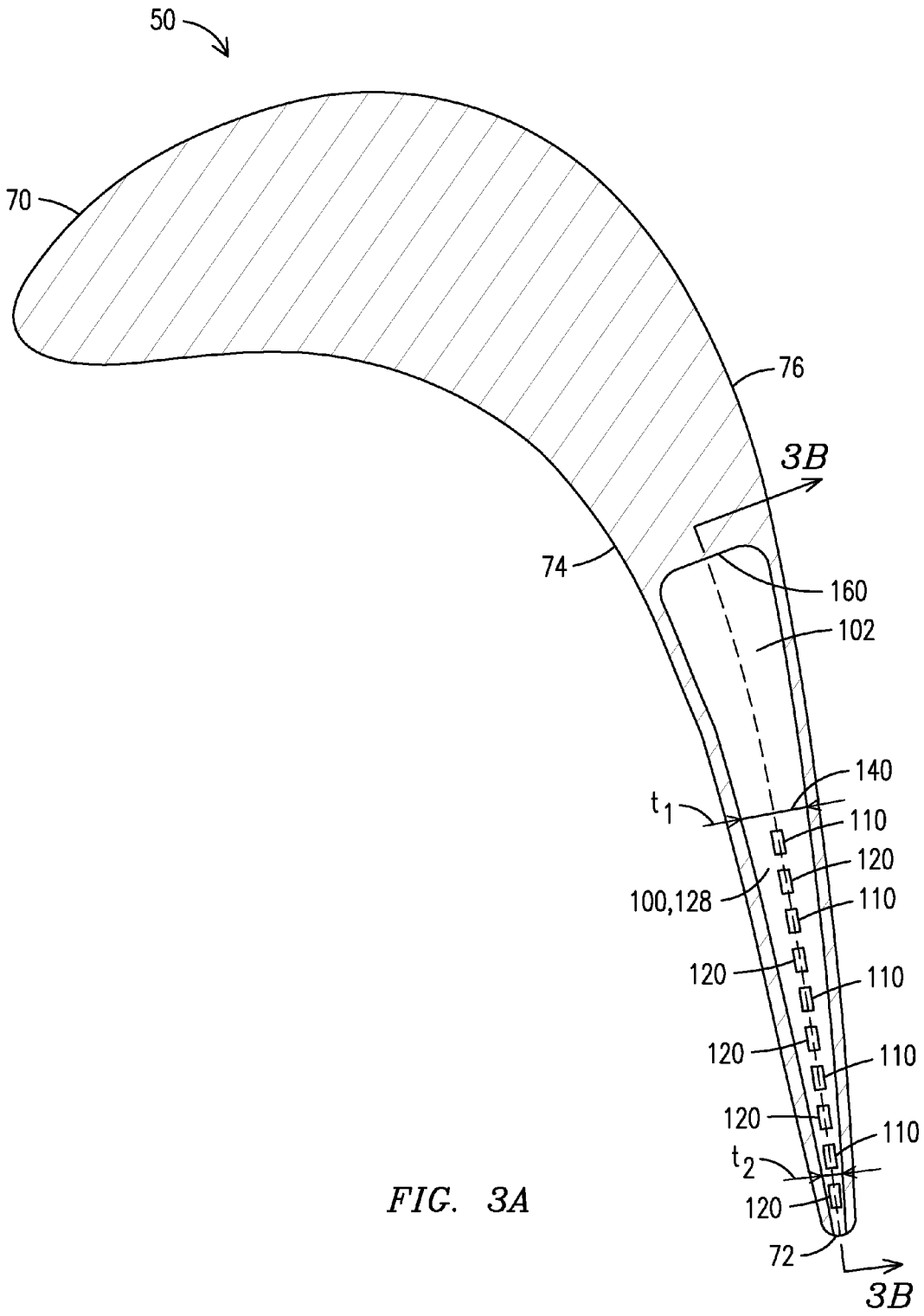
FIG. 3A provides a view in cross section of the turbine blade 50 shown in FIG. 2.

In one example application of the invention, an array 100 of cooling passageways is formed between the pressure and suction side walls 74, 76 of the turbine blade 50, extending from near the platform 54 to near the upper end 68 of the blade. See FIG. 3A which provides a view in cross section of the blade 50, taken along lines A-A of FIG. 2.

Figure 3B:
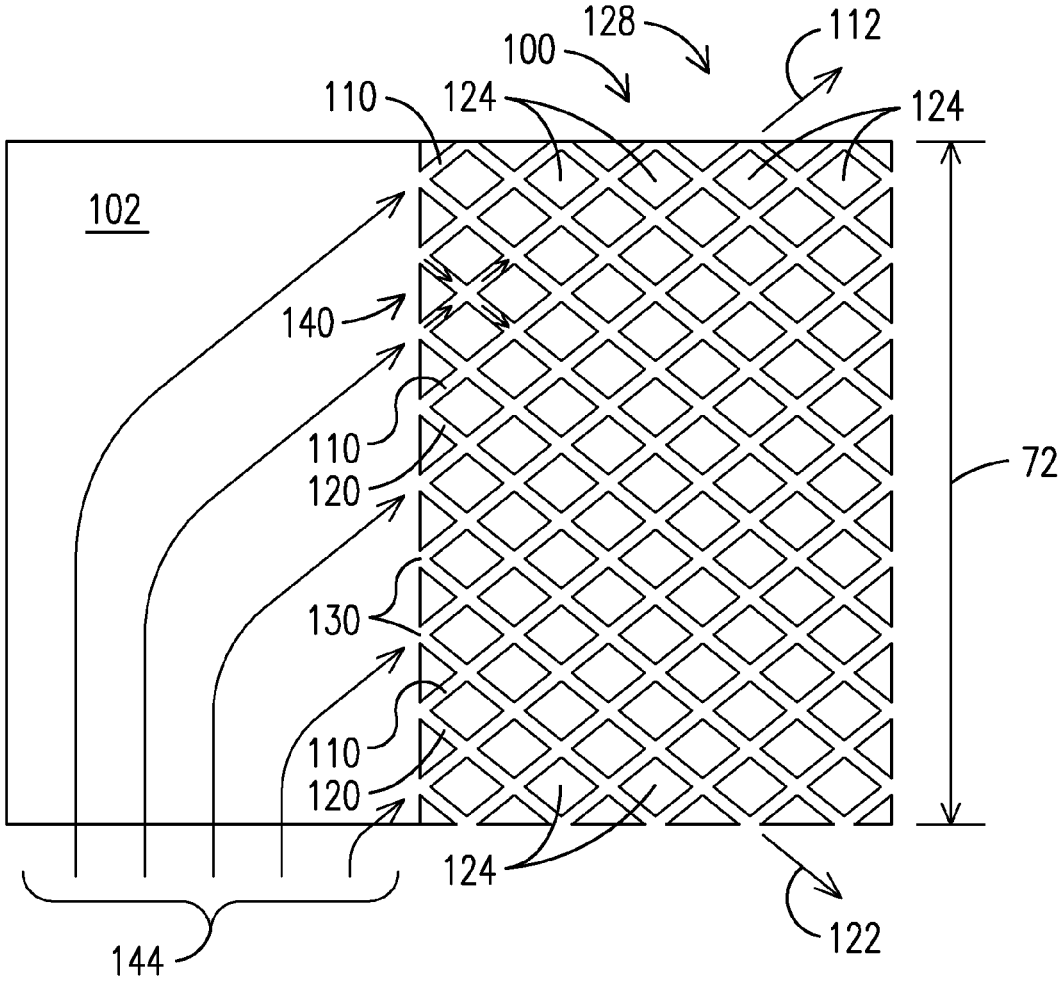
FIG. 3B is a view in cross section of a chamber and an array of cooling passageways taken along the line 3B-3B of FIG. 3A.

The array 100 is integrally formed with the metal casting of the walls 74, 76 and other features of the turbine blade 50. The turbine blade 50 has an interior chamber 102 intermediate the leading edge region 70 and the trailing edge 72. Other chambers, not illustrated, may be positioned between the leading edge region 70 and the chamber 102. The chamber 102 is configured to receive a flow of cooling fluid, e.g., from the compressor 14. With the series of apertures 78 formed along the trailing edge 72, cooling fluid received from the chamber 102 travels through the array 100 of passageways and exits the blade through the apertures 78. In the casting process first and second series of cooling passageways of the array are formed with the passageways extending between the chamber 102 and the apertures 78. See, also, FIG. 3B which provides a view in cross section through the chamber 102 and the array 100, taken along the line 3B-3B of FIG. 3A.

The array 100 includes a first series of cooling passageways 110 extending along a first direction 112, and a second series of cooling passageways 120 extending along a second direction 122. Cooling passageways 110 of the first series and cooling passageways 120 of the second series intersect with one another. The array 100 also includes a plurality of solid regions 124 each defined by a pair of adjacent cooling passageways 110 of the first series and a pair of adjacent cooling passageways 120 of the second series. The solid regions 124 are integrally formed as part of the metal casting from which the pressure and suction sidewalls 74, 76 are fabricated. The resulting structure 128, i.e., a matrix comprising the plurality of solid regions 124 and associated passageways 110 and 120, provides a connection path for cooling fluid to pass along interior surfaces of the blade 50 for transfer of thermal energy from the pressure and suction sidewalls 74, 76 to the cooling fluid. The structure 128 forms a wall 140 of the chamber 102, having a series of inlets 130 to the passageways 110 and 120, essentially creating a manifold for distribution of cooling fluid 144 into the passageways.

A feature of the invention included in the embodiment shown in FIG. 3 is that the resulting structure 128 formed by the plurality of solid regions 124 and associated passageways 110 and 120 is characterized by variable thicknesses between and along the pressure and suction sidewalls. The thickness varies as a function of position along the cooling passageways such that each in a plurality of cooling passageways of the first and second series are characterized by a cross sectional flow area which decreases as a function of distance from the chamber. As shown in FIG. 3A, the thickness of the structure 128, as measured between the pressure and suction sidewalls 74, 76, is $t_1$ along the wall 140 and $t_2$ at a distance from the chamber, which corresponds to a position near the trailing edge 72. That is, $t_1>t_2$ and the structure 128 is tapered, having a maximum thickness along the wall 140, a minimum thickness at positions near the trailing edge 72 and a continuous change in thickness between the wall and the trailing edge. The illustrated tapered geometry is one wherein the structure has a constant change in thickness per unit length along the path from the wall 140 to the apertures 78. Consequently, cross sectional flow area of the passageways 110 and 120 also changes as a function of position between the wall 140 and the apertures 78 so that the passageways are of maximum size near the wall 140 and minimum size at positions farthest away from the wall, e.g., closest to the apertures 78.

The above-described tapering feature of the structure 128 and other structures described herein, and the variable size of the associated passageways, may be further understood with reference to an element 150 of the casting core from which the blade 50 is fabricated. The element 150 is the portion of the core which defines chamber 102, the passageways 110 and 120 and the solid regions 124. See the perspective view of the element 150 in FIG. 3C which comprises a mesh section 100C adjoining a solid ceramic section 102C. The mesh section 100C comprises a series of grid members 110C and 120C arranged in a criss-cross configuration corresponding, respectively, to openings which form the passageways 110 and 120. The solid section 102C corresponds to the chamber 102. Voids 124C between crossing members 110C and 120C correspond to the solid regions 124 which are integrally formed with other portions of the blade 50.

Figure 3D:
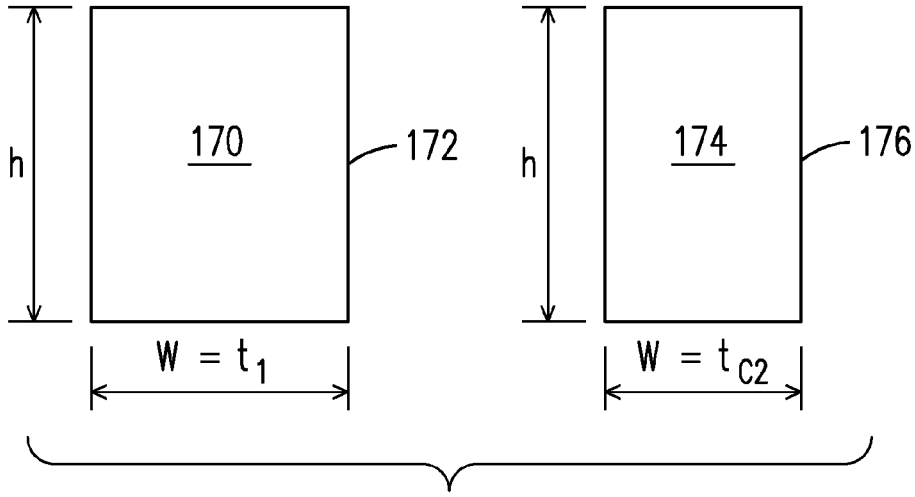
FIG. 3D is a view in cross section illustrating variation in width of a passageway opening according to an embodiment of the invention.

The grid members 110C and 120C extend from the solid portion 102C to an edge region 154C which corresponds to a transition of the array 42 along the trailing edge 72 to the series of apertures 78. The casting element 150 is essentially wedge-shaped or tapered, having a greatest thickness along an edge 160C corresponding to a wall 160 opposite the chamber wall 140 and closest to the leading edge region 70, and having a minimum thickness along the edge region 154C which adjoins the apertures 78. Consequently, the thickness of the grid members 110, 120 diminishes from a maximum thickness $t_{c1}$ along the edge 160C to a minimum thickness $t_{c2}$ along the edge 154. With this geometry the casting results in a variable size for the openings in each of the passageways 110 and 120. That is, the area of the cross section of the passageways diminishes as a function of position relative to the chamber 102 and the apertures 78. The term cross section as used herein refers to a section taken across a passageway which section is in a plane transverse to the direction of the passageway about that plane. For a passageway having a cross section in the shape of a circle, the area of the cross section is the area of the circle. FIG. 3D is a view in cross section of an exemplary passageway representative of the passageways 110 and 120, illustrating a first size 170 (i.e., area in cross section) of a portion 172 the rectangular opening in the passageway at a position near an inlet 130, and a second size 174 (i.e., area in cross section) of a portion 176 of the rectangular opening at or near the trailing edge 72. The openings have the same height, h, but differ in width, w, with the width of the portion 172 of the opening being substantially equal to the thickness $t_1$, and the width of the portion 176 of the opening being substantially equal to the casting core thickness $t_{c2}$.

Figure 4A:
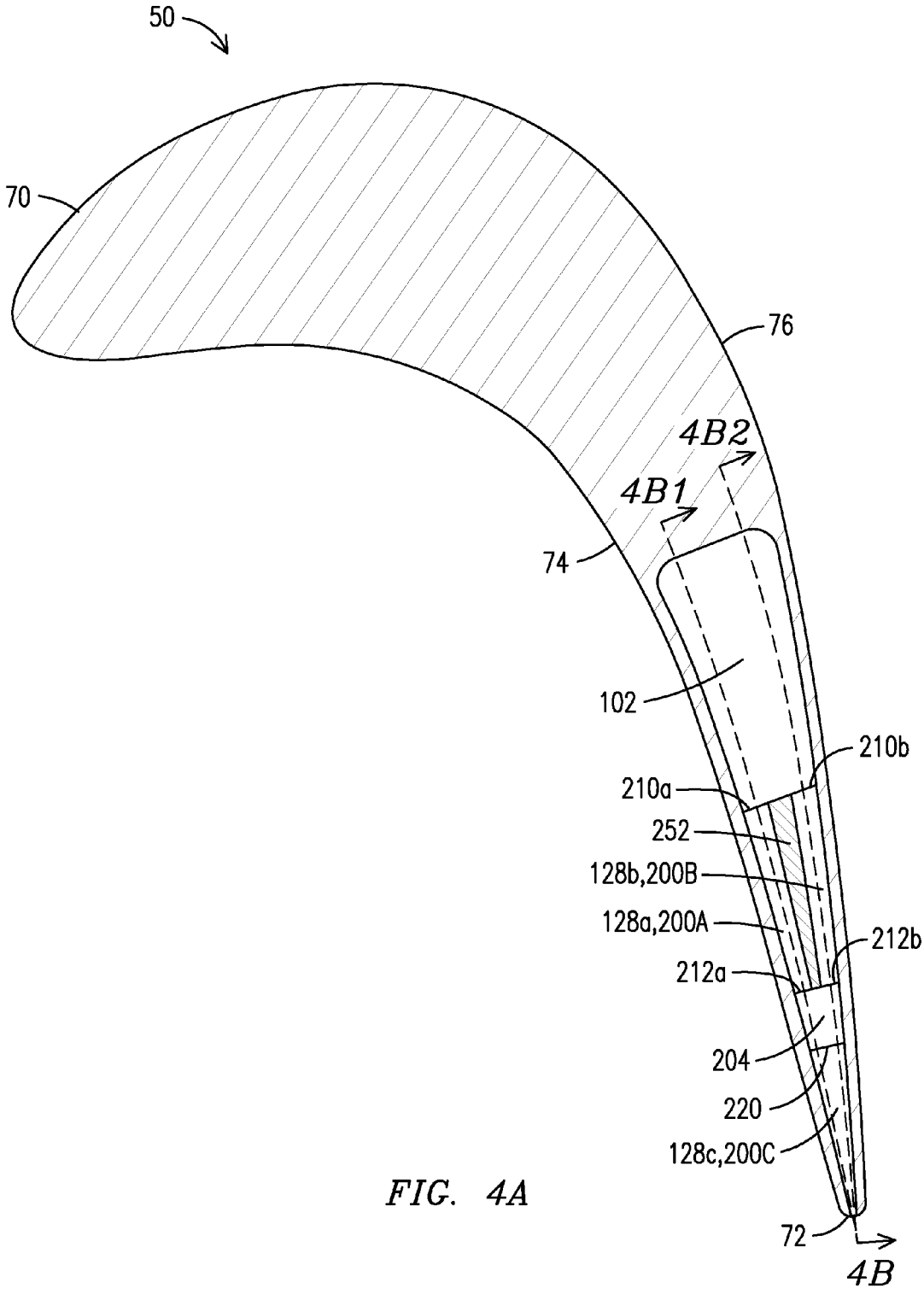
FIG. 4A is a view in cross section of the blade of FIG. 2 incorporating three arrays of passageways according to an alternate embodiment of the invention.

In an alternate embodiment of the invention, first, second and third arrays 200A, 200B and 200C of cooling passageways are formed between the pressure and suction side walls 74, 76 of the turbine blade 50, extending from near the platform 54 to near the upper end 68 of the blade. See FIG. 4A which provides a view in cross section of the blade 50, having the arrays 200A, 200B and 200C formed therein in lieu of the array 100. The view of FIG. 4A is taken along lines A-A of FIG. 2.

The arrays 200A, 200B and 200C are integrally formed with the metal casting of the walls 74, 76 and other features of the turbine blade 50. The turbine blade 50 has an interior chamber 102 intermediate the leading edge region 70 and the trailing edge 72. Other chambers, not illustrated, may be positioned between the leading edge region 70 and the chamber 102. The arrays 200A and 200B are positioned along side one another and the chamber 200C is positioned between the pair of chambers 200A, 200B and the apertures 78. The chamber 102 is configured to receive a flow of cooling fluid, e.g., from the compressor 14. With the series of apertures 78 formed along the trailing edge 72, cooling fluid received from the chamber 102 first travels along parallel paths through each in the pair of the arrays 200A and 200B of passageways, then into an intermediate or junction chamber 204. From the junction chamber 204 the cooling fluid flows into the array 200C of passageways and then exits the blade 50 through the apertures 78. In the casting process first and second series of cooling passageways of each array 200A, 200B, 200C, are formed with the passageways extending between the chamber 102 and the apertures 78. See, also, FIG. 4B which provides an illustration in cross section through the chamber 102, through one of the arrays 200A or 200B and through the array 200C. The illustration of FIG. 4B corresponds to a view in cross section taken along the line 4B-4B1 of FIG. 4A to illustrate features of the arrays 200A and 200C and also corresponds to a view in cross section taken along the line 4B-4B2 of FIG. 4A to illustrate features of the arrays 200B and 200C.

The array 200A includes a first series of cooling passageways 110*a* extending along a first direction 112*a*, and a second series of cooling passageways 120*a* extending along a second direction 122*a*. Cooling passageways 110*a* of the first series and cooling passageways 120*a* of the second series intersect with one another. The array 200A also includes a plurality of solid regions 124*a* each defined by a pair of adjacent cooling passageways 110*a* of the first series and a pair of adjacent cooling passageways 120*a* of the second series. The solid regions 124*a* are integrally formed as part of the metal casting from which the pressure and suction sidewalls 74, 76 are fabricated. The resulting structure 128*a*, i.e., a matrix comprising the plurality of solid regions 124*a* and associated passageways 110*a* and 120*a*, provides a connection path for cooling fluid to pass along interior surfaces of the blade 50 for transfer of thermal energy from the pressure and suction sidewalls 74, 76 to the cooling fluid. The structure 128*a* forms a wall portion 210*a* of the chamber 102, having a series of inlets 130*a* to the passageways 110*a* and 120*a*, essentially creating a manifold for distribution of cooling fluid 144 into the passageways of the array 200A. The structure 128*a* also forms a wall portion 212*a* of the chamber 204 opposite the array 200C, having a series of outlets 216*a* from the passageways 110*a* and 120*a*.

The array 200B includes a first series of cooling passageways 110*b* extending along a first direction 112*b*, and a second series of cooling passageways 120*b* extending along a second direction 122*b*. Cooling passageways 110*b* of the first series and cooling passageways 120*b* of the second series intersect with one another. The array 200B also includes a plurality of solid regions 124*b* each defined by a pair of adjacent cooling passageways 110*b* of the first series and a pair of adjacent cooling passageways 120*b* of the second series. The solid regions 124*b* are integrally formed as part of the metal casting from which the pressure and suction sidewalls 74, 76 are fabricated. The resulting structure 128*b*, i.e., a matrix comprising the plurality of solid regions 124*b* and associated passageways 110*b* and 120*b*, provides a connection path for cooling fluid to pass along interior surfaces of the blade 50 for transfer of thermal energy from the pressure and suction sidewalls 74, 76 to the cooling fluid. The structure 128*b* forms a wall portion 210*b* of the chamber 102, having a series of inlets 130*b* to the passageways 110*b* and 120*b*, essentially creating a manifold for distribution of cooling fluid 144 into the passageways of the array 200B. The structure 128*b* also forms a wall portion 212*b* of the chamber 204 opposite the array 200C, having a series of outlets 216*b* from the passageways 110*a* and 120*a*.

The array 200C includes a first series of cooling passageways 110*c* extending along a first direction 112*c*, and a second series of cooling passageways 120*c* extending along a second direction 122*c*. Cooling passageways 110*c* of the first series and cooling passageways 120*c* of the second series intersect with one another. The array 200C also includes a plurality of solid regions 124*c* each defined by a pair of adjacent cooling passageways 110*c* of the first series and a pair of adjacent cooling passageways 120*c* of the second series. The solid regions 124*c* are integrally formed as part of the metal casting from which the pressure and suction sidewalls 74, 76 are fabricated. The resulting structure 128*c*, i.e., a matrix comprising the plurality of solid regions 124*c* and associated passageways 110*c* and 120*c*, provides a connection path for cooling fluid to pass along interior surfaces of the blade 50 for transfer of thermal energy from the pressure and suction sidewalls 74, 76 to the cooling fluid. The structure 128*c* forms a wall 220 of the chamber 204, opposing the wall portions 212*a* and 212*b* of the structures 128*a* and 128*b*. Along the wall 220 there are formed a series of inlets 130*c* to the passageways 110*c* and 120*c*, essentially creating a manifold for distribution of cooling fluid 144 into the passageways of the array 200C. The passageways 110*c* and 120*c* terminate in a series of outlets 230 adjoining or merging into the series of apertures 78.

A feature of the invention included in the embodiment shown in FIG. 4 is that the resulting structures 128*a*, 128*b* and 128*c*, like the structure 128 of FIG. 3, formed by the plurality of solid regions 124 and associated passageways 110 and 120, are characterized by variable thicknesses between and along the pressure and suction sidewalls. The thickness varies as a function of position along the cooling passageways such that each in a plurality of cooling passageways of the first and second series of each array are characterized by a cross sectional flow area which decreases as a function of distance from the chamber. As shown in FIG. 4A, the thickness of the structure 128*a*, as measured between the pressure and suction sidewalls 74, 76, is greater along the structure wall portion 210*a* than the thickness of the same structure along the wall portion 212*a* in the chamber 204. Similarly, the thickness of the structure 128*b*, as measured between the pressure and suction sidewalls 74, 76, is greater along the structure wall portion 210*b* than the thickness of the same structure along the wall portion 212*b* in the chamber 204. The thickness variations in the structures 128*a* and 128*b* are analogous to the characterization of the array 100 having $t_1>t_2$, the structures 128*a* and 128*b* being tapered, having a maximum thickness along a wall in the chamber 102 and a minimum thickness at positions closest to the trailing edge 72, with a continuous change in thickness between the wall in the chamber 102 and the trailing edge. The illustrated tapered geometry is one wherein the structure 128*a* or 128*b* has a constant change in thickness per unit length along the path from the wall in the chamber 102 to the chamber 204. Consequently, cross sectional flow area of the passageways 110*a*, 110*b* and 120*a*, 120*b* also changes as a function of position between the chamber 102 and the chamber 204 so that the passageways are of maximum size near the chamber 102 and a minimum size near the chamber 204, i.e., at positions farthest away from the chamber 102.

Another feature of the embodiment of the invention shown in FIG. 4 is that the resulting structure 128*c*, like the structure 128 of FIG. 3, formed by the plurality of solid regions 124*c* and associated passageways 110*c* and 120*c*, are characterized by variable thicknesses between and along the pressure and suction sidewalls. The thickness varies as a function of position along the cooling passageways such that each in a plurality of cooling passageways of the first and second series of the array 200C are characterized by a cross sectional flow area which decreases as a function of distance from the chamber 204. As shown in FIG. 4A, the thickness of the structure 128*c*, as measured between the pressure and suction sidewalls 74, 76, is greater along the wall 220 than the thickness of the same structure along the series of outlets 230.

This variation in thickness along the structure 128*c* is analogous to the characterization of the array 100 having $t_1>t_2$, the structure 128*c* being tapered, having a maximum thickness along the wall 220 in the chamber 102 and a minimum thickness at positions closest to the trailing edge 72, with a continuous change in thickness between the wall 220 and the trailing edge. The illustrated tapered geometry is one wherein the structure 128*c* has a constant change in thickness per unit length along the passageways from the wall 220 in the chamber 204 to the outlets 230.

Consequently, cross sectional flow areas of the passageways 110*c* and 120*c* also change as a function of position between the chamber 204 and the outlets 230 so that the passageways are of maximum size near the chamber 204 and a minimum size near the outlets 230, i.e., at positions farthest away from the chamber 204. Such variations in cross sectional flow areas of the passageways 110*c* and 120*c* increase the velocity of cooling fluid as the fluid progresses through the narrowest portion of the blade, i.e., along portions of the walls adjacent the trailing edge 72. This can be particularly beneficial as the increased velocity can result in a higher rate of heat transfer in the relatively narrow trailing edge portion of the gas turbine airfoil which may comprise up to about one third of the total airfoil external surface area. With the trailing edge made relatively thin for aerodynamic efficiency, and receiving heat input on two opposing wall surfaces which are relatively close to each other, a relatively high coolant flow speed is desired to provide the requisite rate of heat transfer for maintaining mechanical integrity. In accord with the invention, variations in cross sectional flow areas of the passageways 110*c* and 120*c* increase the velocity of cooling fluid as the fluid progresses through the narrowest portion of the blade to maximize the rate of heat transfer from the walls 74 and 76 to the cooling fluid flowing through the passageways.

The above-described features of a turbine blade 50 incorporating the arrays 200A, 200B and 200C of passageways in the structure 128*a*, 128*b* and 128*c*, and the variable size of the associated passageways, may be further understood with reference to an element 250 of the casting core from which this alternate embodiment of the blade 50 is fabricated. The element 250 is the portion of the core which defines the chamber 102, the passageways 110*a*, 110*b*, 110*c*, and 120*a*, 120*b* and 120*c*, the chamber 204 and the solid regions 124*a*, 124*b* and 124*c*. See the partial perspective view of the element 250 in FIG. 4C which comprises a pair of spaced-apart mesh sections 300A and 300B adjoining a solid ceramic section 102C. The mesh section 300A corresponds to the array of passageways 200A and the structures 128*a* cast therefrom, and the mesh section 300A corresponds to the array of passageways 200B and the structures 128*b* cast therefrom. The mesh section 300B is an array 260 of grid members and mesh section 300A is an array 270 of grid members. Grid members in the arrays 260 and 270 are similar to the series of grid members 110C and 120C of the casting core element 150 of FIG. 3C. That is, grid members of each array 260, 270 are arranged in a criss-cross configuration corresponding, respectively, to openings which form the passageways 110*a*, 120*a* and 110*b*, 120*b*. The solid section 102C corresponds to the chamber 102. Voids between crossing members in the array 260 correspond to the solid regions 124*a* which are integrally formed with other portions of the blade 50, and voids between crossing members in the array 270 correspond to the solid regions 124*b* which also are integrally formed with other portions of the blade 50. The arrays 260 and 270 of grid members each extend from the solid portion 102C to a second solid section 204C which corresponds to the chamber 204.

A third mesh section 300C adjoins the solid ceramic section 204C and corresponds to the array 200C of passageways and the structures 128*c*. The mesh section 300C comprises an array 280 of grid members each member similar to members in the series of grid members 110C and 120C of the casting core element 150 of FIG. 30. That is, grid members in the array 280 are arranged in a criss-cross configuration and correspond, respectively, to openings which form the passageways 110*c* and 120*c*. An edge region 290C of the mesh section 300C farthest away from the solid ceramic section 204C corresponds to a transition of the array 200C along the trailing edge 72 to the series of apertures 78.

The casting element 250 is essentially wedge-shaped or tapered, having a greatest thickness along or near the transition from the solid section 102C to the pair of spaced-apart mesh sections 300A and 300B, and a minimum thickness along the edge region 290C.

Consequently, the thickness of the grid members in the array 280 diminishes from a maximum thickness, along or near the transition of the array to the solid section 102C, to a minimum thickness along or near the edge region 290C. With this geometry the casting element 250 provides a variable size for the openings in each of the passageways 110*c* and 120*c*. That is, the area of the cross section of the passageways 110*c* and 120*c* diminishes as a function of position relative to the chamber 204 and the apertures 78.

Analogous to the views in cross section shown in FIG. 3D (of an exemplary passageway representative of the passageways 110 and 120, and illustrating first and second sizes of portions of openings), the openings near the inlets 130*c* of the passageways in the array 200C and the openings near the outlets 230 of the passageways in the array 200C have the same height, h, but differ in width, w, the widths of the portions of the openings near the outlets 230 being smaller than the widths of the portions of the openings near the inlets 130*c*.

An advantage of the embodiment shown in FIG. 4 is that the core element 250 can be designed to provide passageways in the array 200A which are sized to transmit a larger volumetric flow than the passageways in the array 200B. With the array 200 A spaced-apart from the array 200B, an intervening partition 252 is positioned between the arrays and the arrays can have different densities of passageways, i.e., passageways that are spaced closer to one another in one of the arrays or passageways that have larger flow openings to accommodate higher flow rates than passageways in the other array. This feature can provide a higher rate of heat transfer along the pressure side wall 74 than along the suction side wall 76.

Figure 5A:
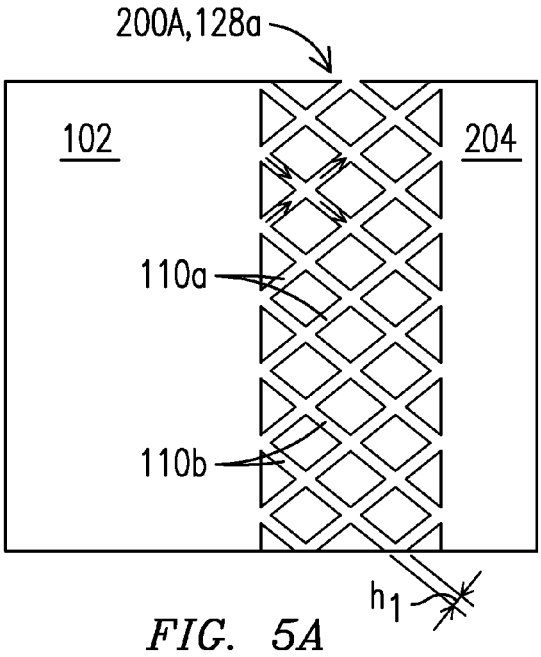
FIGS. 5A and 5B illustrate differences in mesh patterns in the arrays according to an embodiment of the invention.
Figure 5B:
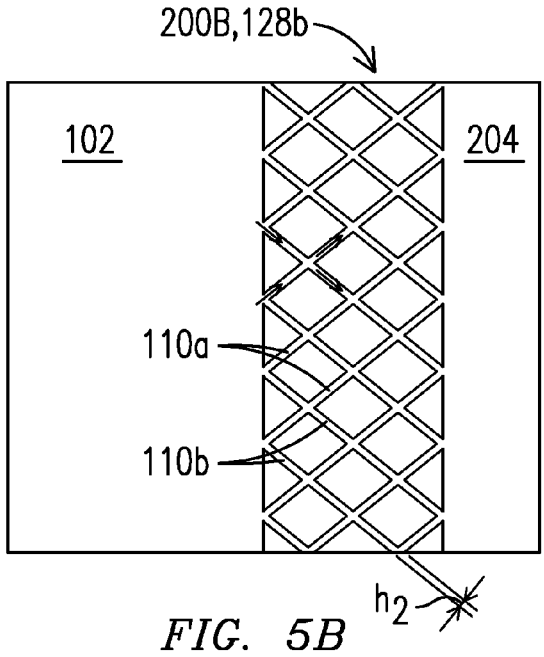

As a first example of this design flexibility, FIGS. 5A and 5B are cross sectional views through the blade 50 which illustrate design variations of the arrays 200A and 200B. To illustrate differences in mesh patterns in the arrays, the view of FIG. 5A is taken through the array 200A (e.g., along the line 4B-4B1 of FIG. 4A) and the view of FIG. 5B is taken through the array 200B (e.g., along the line 4B-4B2 of FIG. 4A). As noted with respect to FIG. 3D, tapering of the array structures 128*a* and 128*b* results in variations of the width, w, of the passageways as a function of position between the leading edge region and the trailing edge of the blade. As indicated in FIGS. 5A and 5B, the height of the passageways differs between the arrays, rendering a difference in volumetric flow of passageways of one array relative to the other array. Specifically, the height, $h_1$, of the passageways of the array 200A is greater than the height, $h_2$, of the passageways of the array 200B.

Figure 6B:
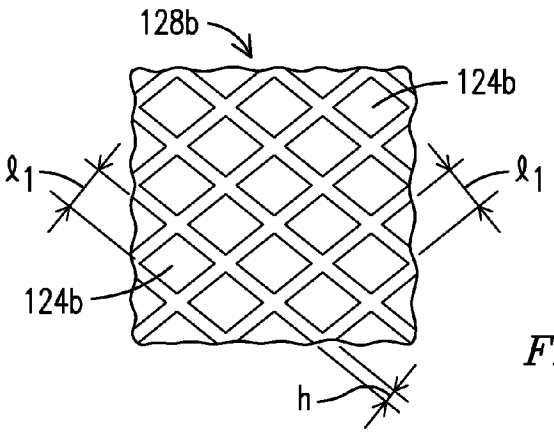
FIGS. 6A and 6B illustrate differences in density of the mesh patterns in arrays according to another embodiment of the invention.
Figure 6A:
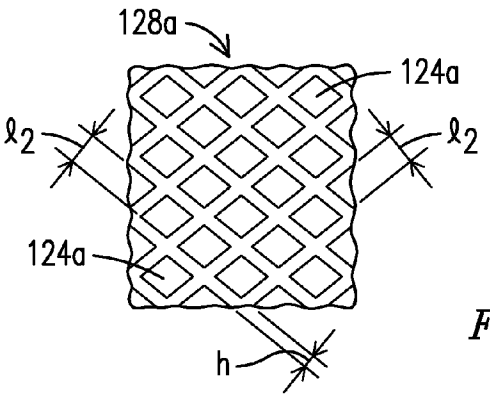

As a second example of this design flexibility, FIGS. 6A and 6B are partial cross sectional views through the blade 50 which illustrate design variations of the arrays 200A and 200B. To illustrate differences in density of the mesh patterns in the arrays, the view of FIG. 6A is taken through the array 200A (e.g., along the line 4B-4B1 of FIG. 4A) and the view of FIG. 6B is taken through the array 200B (e.g., along the line 4B-4B2 of FIG. 4A). For simplicity of illustration, the passageways 110*a* and 120*a* of the structure 128*a* are shown to have the same height, h, as the passageways 110*b* and 120*b* of the structure 128*b*, but these can be varied in accord with the example shown in FIG. 5. The solid regions 124*a* and 124*b* of the structures 128*a* and 128*b* are shown to be of the same quadrilateral shape, but having different dimensions such that the regions 124*a* are smaller than the regions 124*b*. That is, the sides of the regions 124*a* are each of a smaller length $l_1$ than the length $l_2$ of the sides of the regions 124*b*. Consequently, the number of passageways 110*a* and 120*a* provided in the structure 128*a* is greater than the number of passageways 110*b* and 120*b* provided in the structure 128*b*. That is, the pitch of passageways 110*a* and 120*a* is finer than the pitch of the passageways 110*b* and 120*b*. This enables the structure 128*a* to provide a higher level of heat exchange to the pressure side wall 74 than the structure 128*b* provides to the suction side wall 76.

The invention has been described in the context of an airfoil, e.g., a turbine blade, and a gas turbine engine having a compressor, a combustor, and turbine, the turbine including an airfoil. In each context, an embodiment of the airfoil has leading and trailing edges, opposing pressure and suction sidewalls extending between the leading and trailing edges, and an interior chamber intermediate the leading and trailing edges. Also in accord with the example embodiment, the chamber is configured to receive a flow of cooling fluid, and the airfoil has a first structure containing cooling passageways extending between the chamber and a series of apertures positioned along the trailing edge through which cooling fluid received from the chamber exits the airfoil. The first structure includes a first series of cooling passageways extending along a first direction and a second series of cooling passageways extending along a second direction. Cooling passageways of the second series intersect cooling passageways of the first series. The first structure includes a plurality of solid regions each defined by a pair of adjacent cooling passageways of the first series and a pair of adjacent cooling passageways of the second series and the structure is characterized by a variable thickness between the pressure and suction sidewalls as a function of position along the cooling passageways. Each in a plurality of the cooling passageways of the first and second series are characterized by a cross sectional flow area which decreases as a function of distance from the chamber. Also in accord with the disclosed examples, cooling passageways of the first series extend along the first direction substantially parallel with one another and cooling passageways of the second series extend along the second direction substantially parallel with one another.

Figure 4B:
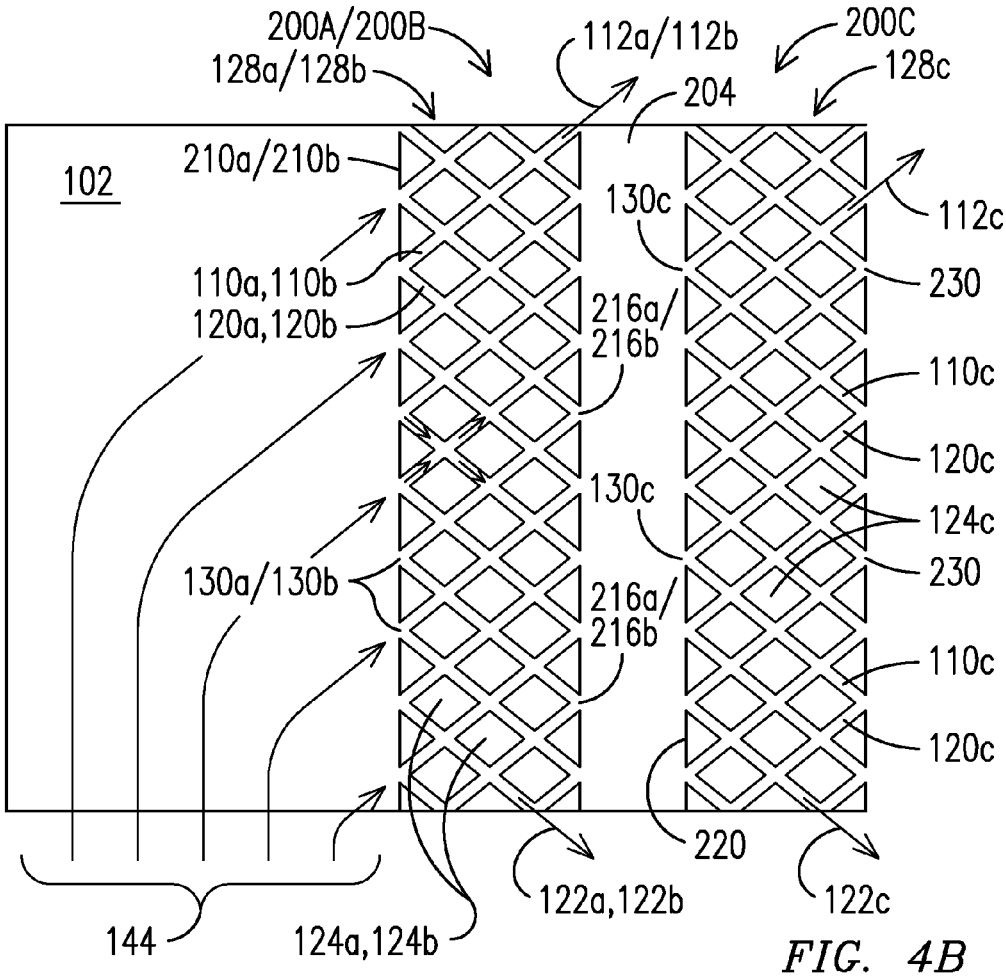
FIG. 4B is a view in cross section through the blade of FIG. 2 further illustrating features of the arrays shown in FIG. 4A.

As illustrated in FIGS. 4A and 4B, the airfoil may include one or more additional structures, each integrally formed with the first structure and the pressure and suction sidewalls and also extending between the pressure and suction sidewalls. Accordingly, each of the one or more additional structures includes a first series of cooling passageways extending along a first direction and a second series of cooling passageways extending along a second direction, with cooling passageways of the second series intersecting cooling passageways of the first series. Although FIG. 4A illustrates two such structures 128*a* and 128*b* in a parallel arrangement, followed by the structure 128*c*, other arrangements are contemplated, such as provision of on array structure in lieu of the two structures 128*a*, 128*b*, followed by the structure 128*c*.

As illustrated in FIGS. 4A and 4B, the first structure and a second of the structures may each form a portion of a wall of the chamber with inlets to multiple ones of the cooling passageways in the first and second structures formed along the wall of the chamber. An additional one of the structures, e.g., structure 128*c*, may extend between each of the first and second structures and the series of apertures positioned along the trailing edge such that cooling passageways in the additional one of the structures are positioned to receive cooling fluid from one or both of the first and second structures and pass the cooling fluid through the apertures. As illustrated in the figures, the additional structure, e.g., structure 128*c*, may be spaced apart from the first and second structures while being integrally formed therewith and between the pressure and suction sidewalls of the airfoil.

The second structure may comprise a plurality of solid regions each defined by a pair of adjacent cooling passageways of the first series and a pair of adjacent cooling passageways of the second series, with the structure characterized by a variable thickness between the pressure and suction sidewalls as a function of position along the cooling passageways. See, again, FIGS. 4A and 4B. Each in a plurality of cooling passageways of the first and second series are characterized by a cross sectional flow area which decreases as a function of distance from the chamber.

A method has also been described for operating a gas turbine engine whereby cooling fluid effects heat transfer from a pressure sidewall of an airfoil in a turbine section. The airfoil, as described above, is of the type having a leading edge, a trailing edge and a series of apertures along the trailing edge for emitting the cooling fluid. The method includes providing a chamber within the airfoil for receiving the cooling fluid, and providing a series of passageways extending between the chamber and the apertures. A plurality of the passageways vary in cross sectional area as a function of distance from the chamber so that when fluid received in the chamber travels through a passageway, the fluid has an increasing flow speed as the fluid moves away from the chamber and toward the apertures. In one example embodiment of this method, the step of providing the passageways includes forming the passageways with a first series of the passageways extending along a first direction and a second series of the passageways extending along a second direction, such that passageways of the second series intersect passageways of the first series.

Figure 3C:
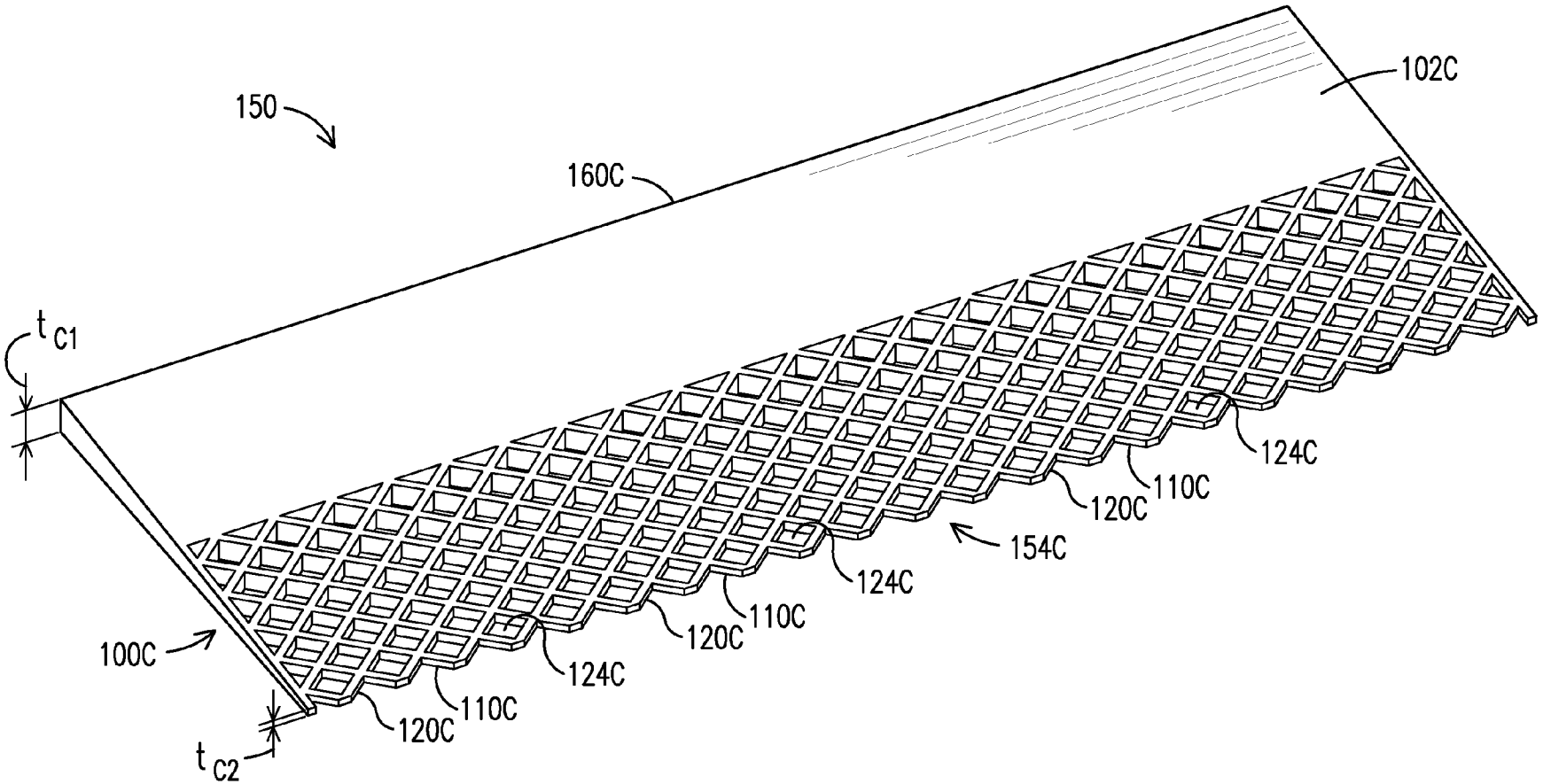
FIG. 3C is a perspective view of an element of a casting core for fabricating features of the embodiment shown in FIGS. 3A and 3B.
Figure 4C:
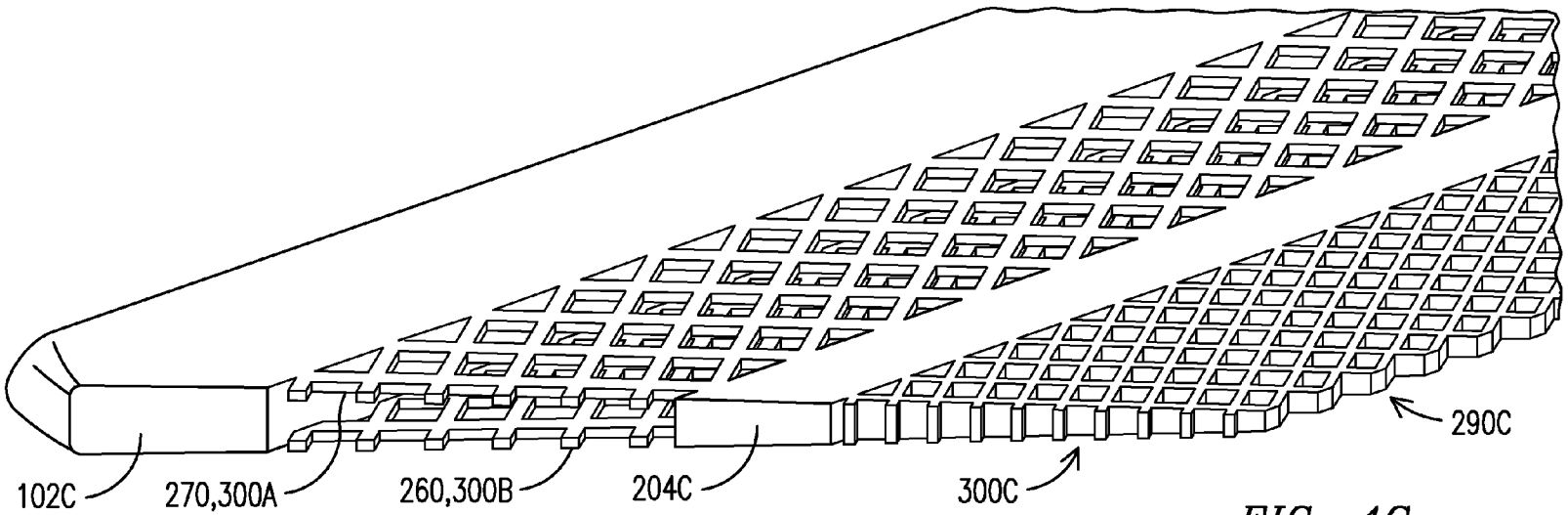
FIG. 4C is a partial perspective view of an element of a casting core for fabricating features of the embodiment shown in FIGS. 4A and 4B.

Also, with reference to FIG. 3C (see, also, FIG. 4C), there has been illustrated an element of a casting core for creating the above-described airfoil. The element includes a solid ceramic section which defines a chamber of the airfoil for receiving cooling fluid and a mesh section adjoining a solid ceramic section comprising a series of grid members. The grid members are arranged in an intersecting criss-cross configuration, each corresponding to a passageway for movement of cooling fluid in the airfoil. The mesh section includes an array of voids between crossing grid members, each corresponding to a solid region positioned between crossing passageways in the airfoil. The grid members extend from the solid portion to an edge region corresponding to a portion of the airfoil relatively close to the trailing edge where the passageways transition to a series of apertures along the trailing edge for emitting the cooling fluid. The mesh section of the casting element is of a tapered shaped, having a greater thickness along a distal edge adjoining the solid ceramic section, and having a lesser thickness along the edge region which corresponds to the transition of the passageways to the apertures. The thicknesses of the grid members thereby diminish from a first thickness along the distal edge to a lesser thickness along the edge region which corresponds to the transition of the passageways to the apertures.

While various embodiments of the present invention have been shown and described herein, it will be obvious that such embodiments are provided by way of example only. Many modifications and changes will be apparent to those skilled in the art. Numerous variations, changes and substitutions may be made without departing from the invention herein. Accordingly, it is intended that the invention be limited only by the spirit and scope of the appended claims.

The claimed invention is:

1. A gas turbine engine comprising a compressor, a combustor, and turbine, the turbine including an airfoil of the type having leading and trailing edges, opposing pressure and suction sidewalls extending between the leading and trailing edges, and an interior chamber intermediate the leading and trailing edges, the chamber configured to receive a flow of cooling fluid, said airfoil comprising a first structure containing cooling passageways extending between the chamber and a series of apertures positioned along the trailing edge through which cooling fluid received from the chamber exits the airfoil, the first structure including:

a first series of cooling passageways extending along a first direction; and a second series of cooling passageways extending along a second direction, with cooling passageways of the second series intersecting cooling passageways of the first series, the first structure comprising a plurality of solid regions each defined by a pair of adjacent cooling passageways of the first series and a pair of adjacent cooling passageways of the second series, wherein the structure is characterized by a variable thickness between the pressure and suction sidewalls as a function of position along the cooling passageways such that each in a plurality of the cooling passageways of the first and second series are characterized by a cross sectional flow area which decreases as a function of distance from the chamber, wherein the first structure is integrally formed with the pressure and suction sidewalls and extends between the pressure and suction sidewalls, said airfoil further comprising one or more additional structures, each integrally formed with the first structure and the pressure and suction sidewalls and also extending between the pressure and suction sidewalls, each of the one or more additional structures including a first series of cooling passageways extending along a first direction and a second series of cooling passageways extending along a second direction, with cooling passageways of the second series intersecting cooling passageways of the first series, wherein the first structure and a second of the structures each form a portion of a wall of the chamber with inlets to multiple ones of the cooling passageways in the first and second structures formed along the wall of the chamber.

2. The gas turbine engine of claim 1 wherein an additional one of the structures extends between each of the first and second structures and the series of apertures positioned along the trailing edge such that cooling passageways in the additional one of the structures are positioned to receive cooling fluid from one or both of the first and second structures and pass the cooling fluid through the apertures.

3. The gas turbine engine of claim 2 wherein the additional structure is spaced apart from the first and second structures while integrally formed therewith and between the pressure and suction sidewalls of the airfoil.

4. A gas turbine engine comprising a compressor, a combustor, and turbine, the turbine including an airfoil of the type having leading and trailing edges, opposing pressure and suction sidewalls extending between the leading and trailing edges, and an interior chamber intermediate the leading and trailing edges, the chamber configured to receive a flow of cooling fluid, said airfoil comprising a first structure containing cooling passageways extending between the chamber and a series of apertures positioned along the trailing edge through which cooling fluid received from the chamber exits the airfoil, the first structure including:

a first series of cooling passageways extending along a first direction;

a second series of cooling passageways extending along a second direction, with cooling passageways of the second series intersecting cooling passageways of the first series, the first structure comprising a plurality of solid regions each defined by a pair of adjacent cooling passageways of the first series and a pair of adjacent cooling passageways of the second series, wherein the structure is characterized by a variable thickness between the pressure and suction sidewalls as a function of position along the cooling passageways such that each in a plurality of the cooling passageways of the first and second series are characterized by a cross sectional flow area which decreases as a function of distance from the chamber, wherein the structure is integrally formed with the pressure and suction sidewalls and extends between the pressure and suction sidewalls, said airfoil further comprising one or more additional structures, each integrally formed with the first structure and the pressure and suction sidewalls and also extending between the pressure and suction sidewalls, each of the one or more additional structures including a first series of cooling passageways extending along a first direction and a second series of cooling passageways extending along a second direction, with cooling passageways of the second series intersecting cooling passageways of the first series, wherein the second structure comprises a plurality of solid regions each defined by a pair of adjacent cooling passageways of the first series and a pair of adjacent cooling passageways of the second series, wherein the structure is characterized by a variable thickness between the pressure and suction sidewalls as a function of position along the cooling passageways such that each in a plurality of cooling passageways of the first and second series are characterized by a cross sectional flow area which decreases as a function of distance from the chamber.

5. The gas turbine engine of claim 3 wherein the additional structure comprises a plurality of solid regions each defined by a pair of adjacent cooling passageways of the first series and a pair of adjacent cooling passages of the second series, wherein the structure is characterized by a variable thickness between the pressure and suction sidewalls as a function of position along the cooling passageways such that each in a plurality of cooling passageways of the first and second series are characterized by a cross sectional flow area which decreases as a function of distance from the chamber.

6. The gas turbine engine of claim 5 wherein the solid regions of the first structure and the solid regions of the additional structure are characterized by an area between the associated pairs of adjacent cooling passageways of the first series and the associated pairs of adjacent cooling passageways of the second series, and the area of one of the solid regions of the first structure is larger than the area of the one of the solid regions of the additional structure.

7. The gas turbine engine of claim 6 wherein the area of each of multiple ones of the solid regions of the first structure is greater than the area of each of multiple ones of the solid regions of the additional structure.

8. The gas turbine engine of claim 6 wherein the area of each of the solid regions of the first structure is greater than the area of each of the solid regions of the additional structure.

9. A gas turbine engine comprising a compressor, a combustor, the turbine including an airfoil of the type having leading and trailing edges, opposing pressure and suction sidewalls extending between the leading and trailing edges, and an interior chamber intermediate the leading and trailing edges, the chamber configured to receive a flow of cooling fluid, said airfoil comprising:

a structure having a plurality of spaced-apart arrays of cooling passageways extending between the chamber and a series of apertures positioned along the trailing edge through which cooling fluid received from the chamber exits the airfoil, each array including:

a first series of the cooling passageways extending along a first direction;

a second series of the cooling passageways extending along a second direction, with cooling passageways of the second series intersecting cooling passageways of the first series, each array formed about a plurality of solid regions each defined by a pair of adjacent ones of the cooling passageways of the first series and a pair of adjacent ones of the cooling passageways of the second series, wherein at least one of the arrays is characterized by a variable thickness between the pressure and suction sidewalls as a function of position along the cooling passageways such that each in a plurality of the cooling passageways of the first and second series are characterized by a cross sectional flow area which decreases as a function of distance from the chamber, wherein:

the structure comprises at least first and second spaced-apart arrays of cooling passageways each extending between the chamber and the series of apertures, passageways in the first array extending to the chamber, passageways in the second array extending to the apertures, passageways of the second array positioned to provide cooling to first regions of the pressure and suction sidewalls relatively close to the apertures, passageways of the first array positioned to provide cooling to second regions of the pressure and suction sidewalls positioned farther away from the apertures than the first regions, and the second array is configured to provide a greater rate of heat transfer between the first regions of the pressure and suction sidewalls and cooling fluid passing through passageways of the second array than the rate of heat transfer between second regions of the pressure and suction sidewalls and cooling fluid passing through passageways of the first array.

10. The gas turbine engine of claim 9 wherein, during operation of the engine, cooling fluid passing through the cooling passageways of said at least one of the arrays is characterized by a relatively low speed through portions of passageways closer to the chamber than the apertures, and a relatively high speed through portions of passageways closer to the apertures than the chamber.

11. The gas turbine engine of claim 9 wherein the structure comprises at least first and second spaced-apart arrays of the cooling passageways each extending between the chamber and the series of apertures, passageways in each of the first and second arrays extending to the chamber, the first array adjoining the pressure sidewall and the second array adjoining the suction sidewall, the first array configured to provide a greater rate of heat transfer between the pressure sidewall and cooling fluid passing therethrough than the rate of heat transfer between the suction sidewall and cooling fluid passing through the second array.

12. The gas turbine engine of claim 9 wherein each of the first and second ones of the spaced-apart arrays is characterized by a variable thickness between the pressure and suction sidewalls as a function of position along the cooling passageways such that each in a plurality of cooling passages of the first and second series are characterized by a cross sectional flow area which decreases as a function of distance from the chamber.

13. An airfoil suitable for use in gas turbine engine comprising a compressor, a combustor, and turbine, the turbine airfoil having leading and trailing edges, opposing pressure and suction sidewalls extending between the leading and trailing edges, and an interior chamber intermediate the leading and trailing edges, the chamber configured to receive a flow of cooling fluid, said airfoil comprising:

a first structure containing cooling passageways extending between the chamber and a series of apertures positioned along the trailing edge through which cooling fluid received from the chamber exits the airfoil, the first structure including:

a first series of cooling passageways extending along a first direction; and a second series of cooling passageways extending along a second direction, with cooling passageways of the second series intersecting cooling passageways of the first series, the first structure comprising a plurality of solid regions each defined by a pair of adjacent cooling passageways of the first series and a pair of adjacent cooling passageways of the second series, wherein the first structure is characterized by a variable thickness between the pressure and suction sidewalls as a function of position along the cooling passageways such that each in a plurality of the cooling passageways of the first and second series are characterized by a cross sectional flow area which decreases as a function of distance from the chamber, wherein cooling passageways of the first series extend along the first direction substantially parallel with one another and cooling passageways of the second series extend along the second direction substantially parallel with one another, wherein the first structure is integrally formed with the pressure and suction sidewalls and extends between the pressure and suction sidewalls, the airfoil further comprising one or more additional structures, each integrally formed with the first structure and the pressure and suction sidewalls and also extending between the pressure and suction sidewalls, each of the one or more additional structures including a first series of cooling passageways extending along a first direction and a second series of cooling passageways extending along a second direction, with cooling passageways of the second series intersecting cooling passageways of the first series, wherein the first structure and a second of the structures each form a portion of a wall of the chamber with inlets to multiple ones of the cooling passageways in the first and second structures formed along the wall of the chamber.

14. The airfoil claim 13 wherein an additional one of the structures extends between each of the first and second structures and the series of apertures positioned along the trailing edge such that cooling passageways in the additional one of the structures are positioned to receive cooling fluid from one or both of the first and second structures and pass the cooling fluid through the apertures.

15. The airfoil of claim 14 wherein the additional structure is spaced apart from the first and second structures while integrally formed therewith and between the pressure and suction sidewalls of the airfoil.

16. The airfoil of claim 15 wherein the additional structure comprises a plurality of solid regions each defined by a pair of adjacent cooling passageways of the first series and a pair of adjacent cooling passages of the second series, wherein the structure is characterized by a variable thickness between the pressure and suction sidewalls as a function of position along the cooling passageways such that each in a plurality of cooling passageways of the first and second series are characterized by a cross sectional flow area which decreases as a function of distance from the chamber.

17. The airfoil of claim 16 wherein the solid regions of the first structure and the solid regions of the additional structure are characterized by an area between the associated pairs of adjacent cooling passageways of the first series and the associated pairs of adjacent cooling passageways of the second series, and the area of one of the solid regions of the first structure is larger than the area of the one of the solid regions of the additional structure.

18. The airfoil of claim 17 wherein the area of each of multiple ones of the solid regions of the first structure is greater than the area of each of multiple ones of the solid regions of the additional structure.

* * * * *